US005863471A

United States Patent [19]

Stanek

[11] Patent Number: 5,863,471

[45] Date of Patent: Jan. 26, 1999

[54] COMPRESSIBLE/EXPANDABLE HUMIDIFIER WICK AND METHOD FOR MANUFACTURE

[75] Inventor: Terrence L. Stanek, St. Charles, Mo.

[73] Assignee: Emerson Electric Co., St. Louis, Mo.

[21] Appl. No.: 770,977

[22] Filed: Dec. 20, 1996

[51] Int. Cl.[6] ..... B01F 3/04

[52] U.S. Cl. ..... 261/107; 428/311.71; 428/136

[58] Field of Search ..... 261/107, 104, 261/99; 428/311.71, 136

[56] References Cited

U.S. PATENT DOCUMENTS

| | | | |
|---|---|---|---|
| 2,562,589 | 7/1951 | Uttz . | |
| 2,614,820 | 10/1952 | Boydjieff | 261/107 |
| 2,669,319 | 2/1954 | Inglesby | 261/107 |
| 3,610,589 | 10/1971 | Paulin et al. | 261/30 |
| 3,651,060 | 3/1972 | Goldman . | |
| 3,733,062 | 5/1973 | Bracich | 261/92 |
| 3,781,183 | 12/1973 | Doll . | |
| 3,804,388 | 4/1974 | Jamell | 261/89 |
| 3,814,393 | 6/1974 | Malmgren | 261/80 |
| 3,974,244 | 8/1976 | Donachiue | 261/92 |
| 4,045,238 | 8/1977 | Battista et al. . | |
| 4,076,673 | 2/1978 | Burkholder, Jr. . | |
| 4,287,251 | 9/1981 | King et al. | 428/198 |
| 4,362,090 | 12/1982 | Whiteley | 261/94 |
| 4,540,530 | 9/1985 | Wignall et al. | 261/92 |
| 4,822,533 | 4/1989 | Steiner et al. | 261/72.1 |
| 4,844,842 | 7/1989 | Markl et al. | 261/30 |
| 4,865,775 | 9/1989 | Steiner et al. | 261/24 |
| 4,992,127 | 2/1991 | Kishi et al. . | |
| 5,034,162 | 7/1991 | Chiu | 261/24 |
| 5,110,511 | 5/1992 | Hand | 261/104 |
| 5,133,904 | 7/1992 | Pepper | 261/24 |
| 5,222,375 | 6/1993 | Conrad et al. | 62/271 |
| 5,372,877 | 12/1994 | Kannankeril . | |
| 5,399,299 | 3/1995 | Stengel et al. | 261/30 |
| 5,667,871 | 9/1997 | Goodrich et al. . | |

*Primary Examiner*—C. Scott Bushey
*Attorney, Agent, or Firm*—Arnold, White & Durkee

[57] ABSTRACT

A new and improved humidifier wick and its method of manufacture are disclosed. The humidifier wick is made from a cellulose foam material that is compressed to a predetermined thickness in a dry condition. A series of air flow openings are formed in such material. As a result, the wick is capable of being expanded to a substantially increased thickness when wet in order to allow air to be drawn through the air flow openings for conveying moisturized air by a power driven fan blade from a humidifier into the atmosphere of a room. The air-flow openings are pre-configured in the humidifier wick, when in its dry condition, in order to allow air to pass into and beyond the air flow openings of the wick when it is wet and expanded. The wick may be used by itself or together with a number of similarly constructed wick elements. The method of forming air flow openings in an endless web of cellulose foam material when in a compressed and dried condition; and cutting the endless web of cellulose foam material into discrete individual humidifier wick segments.

17 Claims, 3 Drawing Sheets

COMPRESSIBLE/EXPANDABLE HUMIDIFIER WICK AND METHOD FOR MANUFACTURE

BACKGROUND OF THE INVENTION

The present invention relates to humidifier wicks, and more particularly, to a dry compressed and wet expandable humidifier wick.

Humidifier wicks are currently constructed from pleated or webbed fibrous material, i.e., a paper-like material, which draws water by capillary attraction into the wick from a water reservoir in a humidifier. When wet, the wick enables moisturized air to be drawn through the wick by a motor driven fan blade in order to discharge the moisturized or humidified air from the humidifier into the atmosphere of a room containing the humidifier. Examples of such fibrous humidifier wicks are shown in U.S. Pat. Nos. 4,822,533; 5,034,162 and 5,110,511.

While the aforementioned fibrous humidifier wicks have readily proven to be a suitable absorbent capillary wicking material, they must be packaged in protective cartons due to their considerable size and also to avoid the possibility of damage since such fibrous material constructed wicks are relatively fragile. As will be appreciated, the protective cartons containing such fibrous material wicks require considerable shipping space as well as retail outlet shelf space.

The present invention relates to a humidifier wick that is made from a material, i.e. cellulose foam material, that can be compressed to a predetermined thickness when in a dry condition, but is capable of expanding to a substantially increased thickness when wet. While a material of this type is known per se, having been used in products such as sponges and the like, they have not been usefully constructed for use as a humidifier wick. In the discussion that follows, it will be seen that the humidifier wick of the present invention provides many advantages not currently available with fibrous material wicks, including reducing the shipping volume and shelf storage space, while also providing an improved and economical process for the manufacturer of such improved humidifier wicks.

SUMMARY OF THE INVENTION

Among the several objects and advantages of the present invention include:

- The provision of a new and improved humidifier wick for humidifiers;
- The provision of the aforementioned humidifier wick which is constructed from a material which is compressed to a predetermined thickness when in a dry condition but is capable of being expanded to a substantially increased thickness when wet;
- The provision of the aforementioned humidifier wick which includes air flow openings that are pre-configured when the humidifier wick is in dry condition in order to allow air to pass into and beyond the air flow openings when the humidifier wick is wet and expanded;
- The provision of the aforementioned humidifier wick which reduces the shipping volume and retail outlet shelf space as compared to humidifier wicks of the prior art;
- The provision of the aforementioned humidifier wick which significantly reduces the cost associated with shipping volume and retail outlet shelf space;
- The provision of the aforementioned humidifier wick which can be manufactured by a more simplified, faster, and economical manufacturing process;

- The provision of the aforementioned humidifier wick manufacturing process which eliminates many of the problems associated with fibrous humidifier wick processing techniques;
- The provision of the aforementioned humidifier wick which is simple in construction, made from one-piece of expandable material, is extremely economical to manufacture, ship and store; is easy to use by simply wetting same; and is otherwise well adapted for the purposes intended.

Briefly stated, the humidifier wick of the present invention includes a wick element that is made from a material that is compressed to a predetermined thickness in a dry condition. A series of air flow openings are then formed in such material. The result is a wick that is capable of being expanded to a substantially increased thickness when wet in order to allow air to be drawn through the air flow openings for conveying moisturized air by a humidifier into the atmosphere.

The air flow openings are pre-configured in the humidifier wick when in a dry condition in order to allow air to pass into and beyond the air flow openings of the humidifier wick when wet and expanded.

The air flow openings may be constructed in a variety of different shapes including generally circular-shaped openings or elongated slit shapes which are expanded when the wick is wet. The air flow openings may be separate from each other or interconnected, as may be desired. The air flow openings may comprise a series of adjacent separate openings which are either aligned or generally overlapped with respect to one another. The air flow openings may be formed in one or a plurality of sides or surfaces of the humidifier wick.

The humidifier wick is preferably formed from a cellulose foam material. Such cellulose foam material is preferably capable of expanding from approximately 0.070 inches when dry to approximately one inch when wet.

The humidifier wick is constructed as a one-piece cellulose foam element for use by itself or in conjunction with a series of similarly constructed wicks.

Preferably, the wick element is formed from an endless web of compressed and dried cellulose foam material of predetermined thickness and width. Air flow openings are formed in the compressed and dried endless web of cellulose foam material. Thereafter, the endless web of cellulose foam material with air flow openings are cut into discrete individual segments to form separate humidifier wick elements.

The air flow openings may be punched through or otherwise formed in the endless web of cellular foam material in any desired pattern. Each air flow opening is pre-configured to present a predetermined air flow opening that extends through the wick when the wick material is wet.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way limitation. This description will clearly enable one skilled in the art to make and use the invention, and describes several embodiments, adaptions, variations, alternative and uses of the invention, including what I presently believe is the best mode of carrying out the invention.

Figure 1:
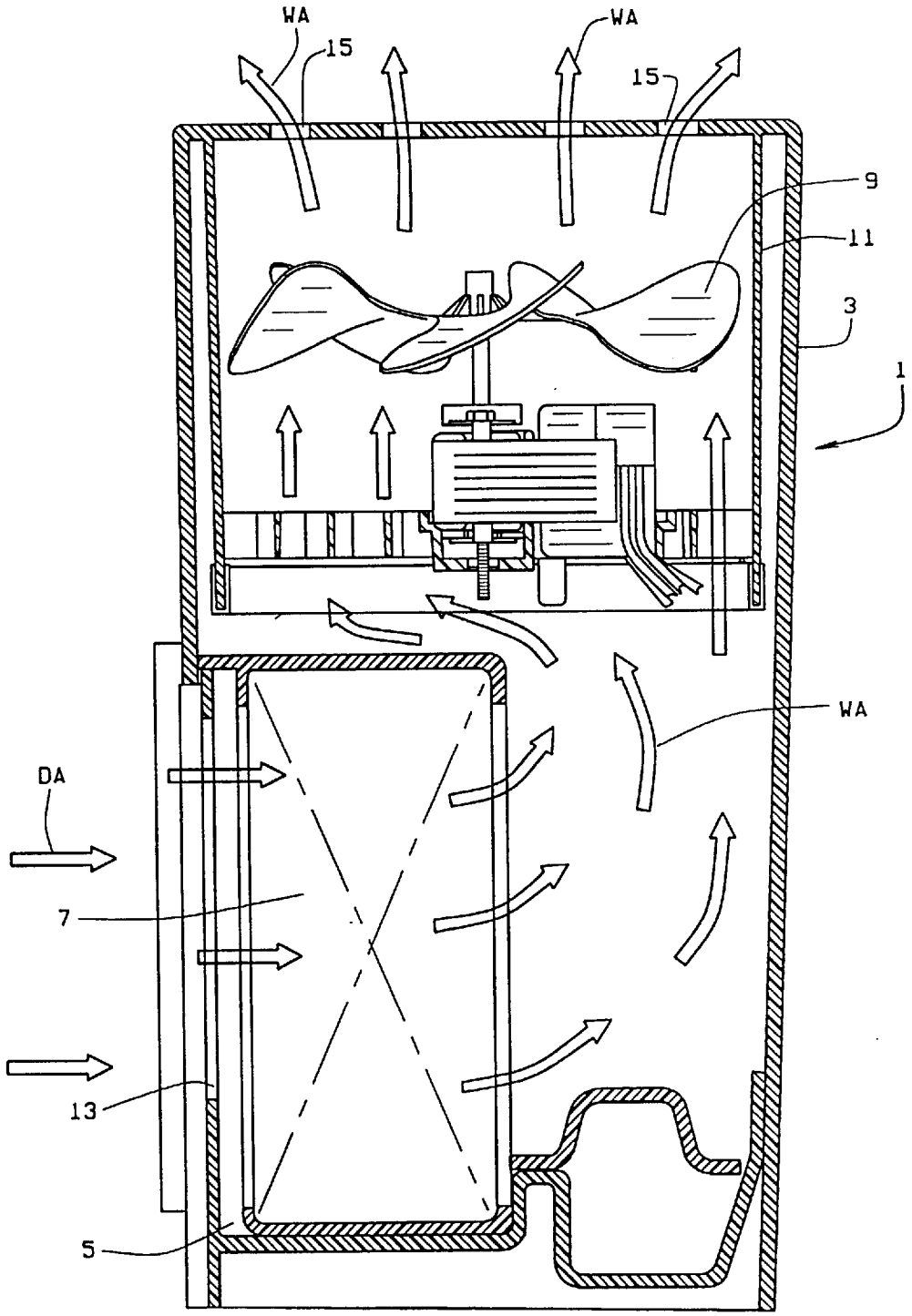
FIG. 1 is an enlarged side elevational view, partly in section, of a typical humidifier unit that is presently used and indicates the manner in which a power driven fan blade draws air through a water absorbed capillary action wick through the humidifier for discharge into the atmosphere of a room.

In order to understand the environment in which the humidifier wick of the present invention is used, reference is first made to FIG. 1 of the drawings which shows a typical capillary action wick humidifier 1. The humidifier 1 includes a housing 3 having a water reservoir 5 at a lower end. The water reservoir may be filled from any suitable source such as through the use of bottles or containers as is well known in the art. An absorbent capillary action wick 7 is mounted in the humidifier 1 such that its lower end is received within the water reservoir 5. This enables water to be carried up into the wick 7 through capillary attraction, as is also well known. At the upper end of the humidifier 1 is a motor driven fan blade 9 which is supported by a frame 11, in a suitable fashion. The motor driven fan blade 9 is operated by suitable controls (not shown) in order to draw dry air, as shown by the arrows DA, into an opening 13 along one side of the humidifier 1 which is adjacent the absorbent capillary action wick 7. As the motor driven fan blade 9 draws the dry air DA through the opening 13 into the absorbent capillary action humidifier 7, the air becomes moisturized or vaporized with water such that when the air leaves the absorbent capillary action wick 7, the air is converted into moisturized or vaporized air as represented by the arrows WA within the humidifier that represent the wet air WA that is drawn by the motor driven fan blade 9 for discharge from the humidifier through openings 15 at the top of the humidifier 1.

Capillary action wicks are currently constructed from a pleated or webbed fibrous material which is a cellulose or paper-like material that readily performs the capillary action function desired. Typical examples are shown in U.S. Pat. Nos. 4,822,533; 5,034,162; and 5,110,511. Due to the considerable size and possibility of damage, such fibrous material capillary action wicks are manufactured by a rather extensive manufacturing process and then shipped in protective cartons to retail outlets. As will be appreciated, considerable shipping volume and retail outlet shelf storage space is required for such fibrous material capillary attraction wicks. As distinct from such prior art wicks, the humidifier wick of the present invention significantly reduces the problems associated with the prior art, while providing many new and important advantages and features not previously obtainable.

Examples of the humidifier wick 21 of the present invention are shown in FIGS. 2–5 of the drawings. The humidifier wick 21 is constructed from a material that has a minimum thickness when in dry condition, but is subsequently capable of being expanded, when wet, to a substantially increased thickness. An example of such material is a cellulose foam material which is currently used for sponges. Such cellulose foam material can be compressed to a predetermined thickness when in a dry condition, but when subsequently wet, is capable of expanding to a substantially increased thickness. For example, a cellulose foam wick can be compressed to approximately 0.070 inches when in a dry condition, but can be expanded to approximately one inch in thickness when wet.

Figure 2:
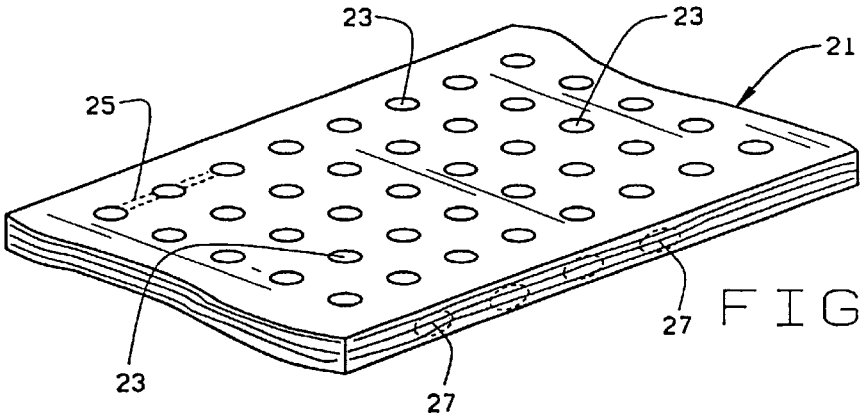
FIG. 2 is a fragmentary sectional view of the humidifier wick of the present invention, when in its dry condition.
Figure 3:
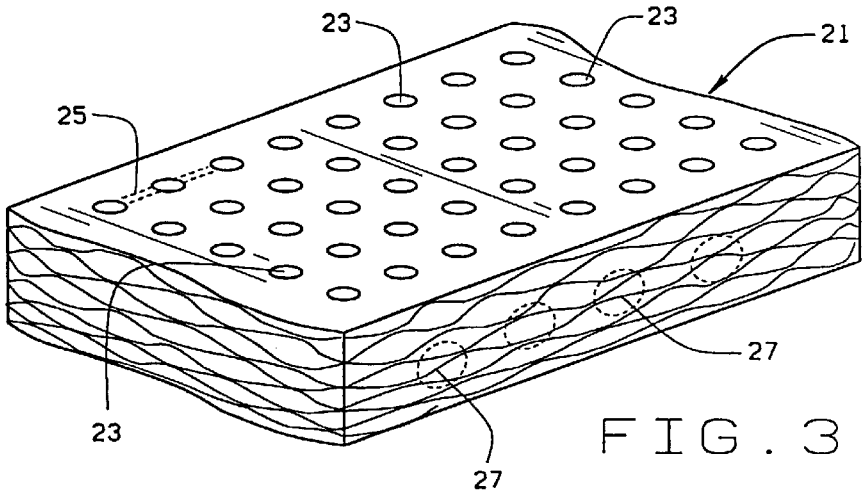
FIG. 3 is a fragmentary perspective view of the humidifier wick of the present invention, when wet and expanded.

In order to function as a capillary action humidifier wick, the compressible/expandable cellulose foam material must be formed with air flow openings 23. In FIGS. 2–3 of the drawings, such air-flow openings are shown as circular-shapes that are arranged in a series of rows in general alignment with one another. The air flow openings 23 must be through openings in the sense that air must be allowed to pass by or flow through the air flow openings 23 when in the expanded condition as shown in FIG. 3 of the drawings. Thus, the air flow openings 23 must be pre-configured in order to allow air to pass into and beyond the air flow openings 23 when the wick element 21 is wet and expanded.

The air flow openings 23 may be formed either separate from one another, as illustrated by the series of rows of aligned air flow openings 23 in FIGS. 2–3 of the drawings or they may be interconnected to one another. For example, the air flow openings 23 may be interconnected such as through the use of suitable slots 25 shown in dotted lines in FIGS. 2–3 of the drawings in order to enable some or all of the openings 23 to be interconnected to one another.

In addition to separate or interconnected openings, air flow openings may also be formed in one of the edge or side surfaces of the humidifier wick 21. In this regard, the phantom openings 27 are shown as being formed in one of the side or edge surfaces of the humidifier wick 21, as may be desired. Such openings 27 may be formed either aligned with or non-aligned relative to the air flow openings 23, as may be desired.

Figure 4:
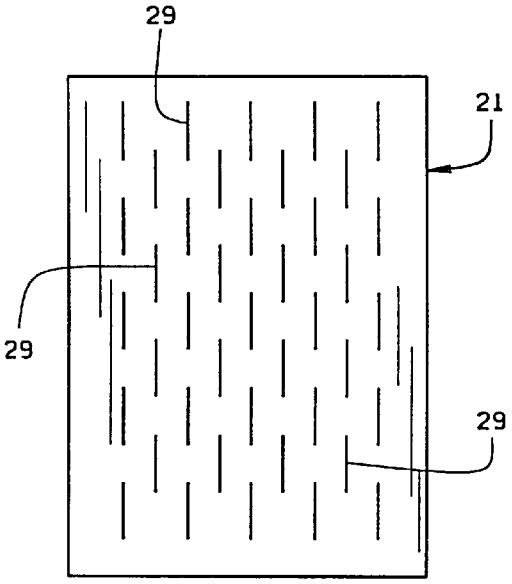
FIG. 4 is a top plan view illustrating a series of slits formed in a dry and compressed humidifier wick.
Figure 5:
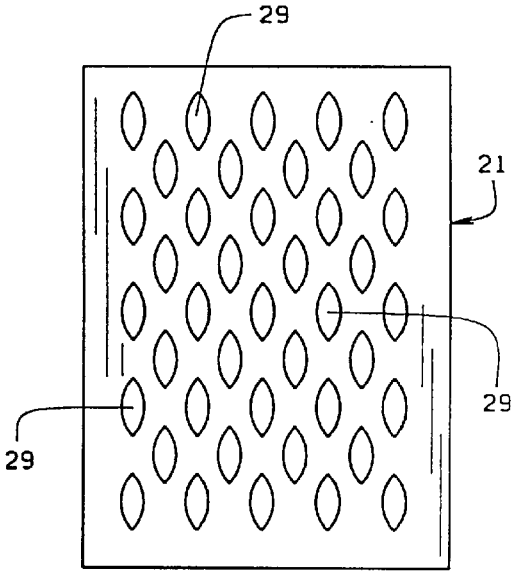
FIG. 5 is a top plan view of the humidifier wick of FIG. 4 when wet and expanded to illustrate the manner in which air flow openings are expanded and formed in the humidifier wick.

The shape of the pre-configured air flow openings may be varied, as may be desired. In this regard, FIG. 4 shows a humidifier wick 21 with a series of overlapping slits 29 formed in the humidifier wick when in a dry and compressed condition. However, when the wick is expanded, as shown in FIG. 5 of the drawings, the slits 29 are shown as expanded to form a teardrop shape, when expanded.

The shape, size and location of the pre-configured air flow openings may be varied as desired, as long as the pre-configured air flow openings in the humidifier wick 21 provide openings large enough to allow air to readily pass through the humidifier wick 21 when wet, in order to achieve the same purposes as the capillary action humidifier wicks of the prior art.

In the use of the humidifier wicks of the present invention, they can be used as individual units and positioned to extend either horizontally or vertically within a humidifier. In some instances, it is preferable to use a multiple of humidifier wicks. In this case, the humidifier wicks of the present invention can be stacked horizontally on top of one another or stacked vertically next to one another or stacked vertically both next to one another as well as being located next to adjacent wicks in front of or behind such vertically stacked wicks. In any use of multiple stacked wicks, it is important that the air flow openings of adjacent wicks cooperate to permit air flow through such multiple wicks.

For this purpose, the air flow openings of adjacent wicks may be at least generally aligned with one another or otherwise cooperate to permit air flow between and through such multiple wicks.

Figure 6:
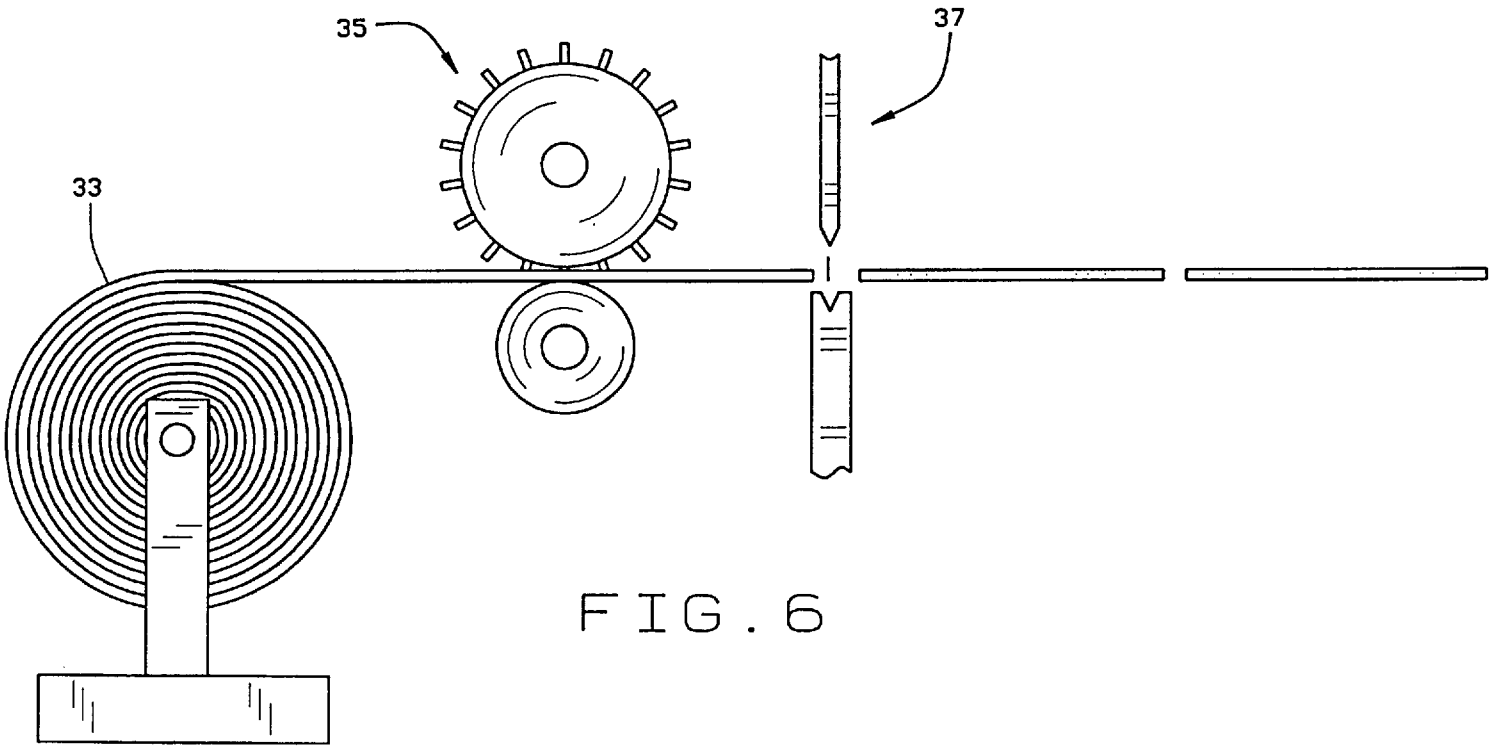
FIG. 6 is a diagrammatic side elevational view illustrating one preferred method of forming the humidifier wicks of the present invention.

One preferred method of manufacturing the humidifier wick 21 of the present invention is shown in FIG. 6 of the drawings.

The method of the present invention is illustrated in FIG. 6 of the drawings. An endless web 33 of cellulose foam material is wound in a roll and fed to a rotary cutting die 35 where desired air flow openings are formed in the endless web 33. Other types of forming dies may be used, if desired. Following the forming of the air flow openings in the endless web 33, the endless web 33 is cut by suitable cutting devices 37 into individual discrete humidifier wicks 21.

The humidifier wicks 21 can then be individually packaged or packaged as a group, in any way that may be desired. Since the cellulose foam material is more durable than the fibrous material from which the capillary wicks of the prior art have been made, the cellulose foam humidifier wicks 21 of the present invention may be packaged in plastic over wraps or shipping envelopes, without the need for protective cushioning. Also, cellulose foam humidifier wicks 21 may be bulk shipped as well.

In any case, the humidifier wick of the present invention significantly reduces the amount of shipping volume and the retail outlet shelf space that is required, as compared with the fibrous material capillary action wicks of the prior art. Assuming a humidifier wick that is compressed to 0.070 inches when dry and expanded to approximately one inch when wet, it will be appreciated that this comparison alone demonstrates that the shipping volume and retail outlet shelf space can be reduced to approximately 7% of the fibrous material capillary action wicks of the prior art. Quite clearly, this also reduces packing and shipping costs, as well. In addition, the process for manufacturing the humidifier wicks of the present invention is a much more simplified, less costly, more controllable manufacturing process than the fibrous material capillary action wicks of the prior art. As a result, it will be understood that the humidifier wick of the present invention, and its related method of manufacture, provide numerous benefits and advantages that have not previously been obtainable.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A humidifier wick comprising:

a wick element made from a material that is compressed to a predetermined thickness in a dry condition, having a series of air flow openings formed in two adjacent surfaces of the wick, said wick capable of being expanded to a substantially increased thickness when wet in order to allow air to be drawn through the air flow openings for conveying moisturized air by a humidifier into the atmosphere.

2. The humidifier wick as defined in claim 1 in which the openings are pre-configured to allow air to pass into and beyond the air flow openings in the wick element when wet and expanded.

3. The humidifier wick as defined in claim 2 in which the air flow openings comprise a series of adjacent separate openings.

4. The humidifier wick as defined in claim 3 in which the air flow openings generally overlap with respect to one another.

5. The humidifier wick as defined in claim 4 in which the air flow openings are generally circular-shaped.

6. The humidifier wick as defined in claim 4 in which the air flow openings each have an elongated slit shape.

7. The humidifier wick as defined in claim 3 in which at least some of the air flow openings are interconnected to one another.

8. The humidifier wick as defined in claim 1 in which the predetermined thickness of the wick element is approximately 0.070 inches when dry and approximately one inch when wet.

9. The humidifier wick as defined in claim 1 in which the wick material is a cellulose foam material.

10. The humidifier wick as defined in claim 9 in which the wick element is one-piece cellulose foam material.

11. The humidifier wick as defined in claim 1 including a series of wick elements of one-piece cellulose foam material associated with respect to one another to enable the air flow openings of each wick element to cooperate with the other wick elements.

12. The humidifier wick as defined in claim 11 in which the series of humidifier wick elements are stacked with respect to one another.

13. The humidifier wick of claim 1 wherein the two adjacent surfaces comprise first and second surfaces, and wherein the first air flow openings formed in the first surface are generally transverse to the air flow openings formed in the second surface.

14. A humidifier wick comprising:

a wick element having a series of adjacent separate through openings, wherein at least some of the openings are interconnected to one another, said wick element capable of being compressed and maintained in a predetermined minimum thickness when in a dry condition;

said wick element capable of being expanded to a substantially increased maximum thickness when wet; and the through openings in the wick element enabling air to be drawn through the wick element when the wick element is wet and expanded for carrying moisturized air into a humidifier.

15. A humidifier wick comprising:

a wick element made from a material that is compressed to a predetermined thickness in a dry condition, the wick capable of being expanded to a substantially increased thickness when wet; and a series of adjacent, separate air flow openings defined by the wick element, at least some of the air flow openings being interconnected to one another, the air flow openings being in a generally overlapping arrangement with respect to one another and being pre-configured to allow air to pass into and beyond the air flow openings in the wick element when wet and expanded for conveying moisturized air by a humidifier into the atmosphere.

16. The humidifier wick as defined in claim 15 in which air flow openings are formed in two adjacent surfaces of the wick.

17. A humidifier wick comprising:

a wick element made from a material that is compressed to a predetermined thickness in a dry condition, the wick capable of being expanded to a substantially increased thickness when wet; and a series of adjacent openings defined by the wick, with at least some of the air flow openings being interconnected to one another, the air flow openings being pre-configured to allow air to pass into and beyond the air flow openings in the wick element when wet and expanded for conveying moisturized air by a humidifier into the atmosphere.

* * * * *

UNITED STATES PATENT AND TRADEMARK OFFICE

CERTIFICATE OF CORRECTION

PATENT NO. : 5,863,471

DATED : January 26, 1999

INVENTOR(S) : Terrence L. Stanek

It is certified that error appears in the above-identified patent and that said Letters Patent is hereby corrected as shown below:

On the title page under References Cited, U.S. Patent Documents, please delete "3,651,060 3/1972" and insert --3,654,060 4/1972-- therefor.

Signed and Sealed this

Third Day of August, 1999

*Attest:*

Q. TODD DICKINSON

*Attesting Officer*

*Acting Commissioner of Patents and Trademarks*